US011207609B2

(12) United States Patent
Rosen et al.

(10) Patent No.: US 11,207,609 B2
(45) Date of Patent: Dec. 28, 2021

(54) MAGNETIC TOY CONSTRUCTION BLOCK WITH RING-TYPE MAGNET

(71) Applicant: LaRose Industries, LLC, Randolph, NJ (US)

(72) Inventors: Lawrence Rosen, Aventura, FL (US); Parviz Daftari, Summit, NJ (US)

(73) Assignee: LAROSE INDUSTRIES, LLC, Randolph, NJ (US)

( * ) Notice: Subject to any disclaimer, the term of this patent is extended or adjusted under 35 U.S.C. 154(b) by 0 days.

(21) Appl. No.: 16/914,133

(22) Filed: Jun. 26, 2020

(65) Prior Publication Data

US 2020/0406156 A1 Dec. 31, 2020

Related U.S. Application Data

(60) Provisional application No. 62/867,439, filed on Jun. 27, 2019.

(51) Int. Cl.
*A63H 33/04* (2006.01)

(52) U.S. Cl.
CPC ..... *A63H 33/046* (2013.01); *A63H 33/042* (2013.01)

(58) Field of Classification Search
CPC ..... A63H 33/046; A63H 33/042
USPC ..... 446/85–128
See application file for complete search history.

(56) References Cited

U.S. PATENT DOCUMENTS 2,970,388 A 2/1961 Yonkers
3,195,266 A 7/1965 Onanian
3,564,758 A 2/1971 Willis
3,998,004 A 12/1976 Ehrlich
4,265,002 A * 5/1981 Hosken ..... A41F 1/002 24/303
4,401,960 A * 8/1983 Uchikune ..... H01F 7/0252 335/285
4,726,588 A 2/1988 Caprio
5,347,253 A 9/1994 Ogikubo
5,520,396 A * 5/1996 Therrien ..... A63F 9/34 273/156
5,746,638 A * 5/1998 Shiraishi ..... A63H 33/046 446/131

(Continued)

FOREIGN PATENT DOCUMENTS

JP 2002159761 A 6/2002
JP 2003190663 A 7/2003

(Continued)

OTHER PUBLICATIONS

Smartmax General Instructions, Smart—Belgium, Brochure with copyright date of 2003-2015.

(Continued)

*Primary Examiner* — Eugene L Kim
*Assistant Examiner* — Matthew B Stanczak
(74) *Attorney, Agent, or Firm* — Lewis Roca Rothgerber Christie LLP

(57) ABSTRACT

A magnetic toy construction block has an interior configured to house a radially magnetized ring magnet, which is rotatably supported within the block by a pair of pedestals extending into the interior of the block from opposite ends thereof. The positions of the poles of the ring magnet are variable relative to the sides of the block in response to the rotation of the ring magnet.

15 Claims, 6 Drawing Sheets

(56) References Cited

U.S. PATENT DOCUMENTS

| | | | | |
|---|---|---|---|---|
| 5,933,926 | A | 8/1999 | Reiter | |
| 6,566,992 | B1 | 5/2003 | Vicentelli | |
| 6,626,727 | B2 | 9/2003 | Balanchi | |
| 6,749,480 | B1 | 6/2004 | Hunts | |
| 6,846,216 | B1 | 1/2005 | Balanchi | |
| 6,963,261 | B2 | 11/2005 | Vicentelli | |
| 6,969,294 | B2 | 11/2005 | Vicentelli | |
| 7,066,778 | B2 | 6/2006 | Kretzschmar | |
| 7,089,627 | B2 | 8/2006 | Seidler | |
| 7,154,363 | B2 | 12/2006 | Hunts | |
| 7,160,170 | B2 | 1/2007 | Yoon | |
| 7,234,986 | B2 | 6/2007 | Kowalski et al. | |
| 7,276,270 | B2 | 10/2007 | Vicentelli | |
| 7,320,633 | B2 | 1/2008 | Park | |
| 7,364,487 | B2 | 4/2008 | Evans et al. | |
| 7,371,147 | B2 | 5/2008 | Tusacciu | |
| 7,413,493 | B2 | 8/2008 | Toht et al. | |
| 7,758,398 | B2 | 7/2010 | Park | |
| 7,833,078 | B2 | 11/2010 | Kretzschmar | |
| 7,955,155 | B2 | 6/2011 | Tremblay et al. | |
| 7,988,518 | B2 | 8/2011 | Kim et al. | |
| 8,016,635 | B2 | 9/2011 | Park | |
| 8,016,636 | B2 | 9/2011 | Park | |
| 8,070,550 | B2 | 12/2011 | Song et al. | |
| 8,100,735 | B2 | 1/2012 | Park | |
| 8,128,452 | B2 | 3/2012 | Klm et al. | |
| 8,292,687 | B2 | 10/2012 | Tremblay et al. | |
| 8,303,366 | B2 | 11/2012 | Tremblay et al. | |
| 8,458,863 | B2 | 6/2013 | Hunts | |
| 8,475,225 | B2 | 7/2013 | Kretzschmar | |
| 8,529,311 | B2 | 9/2013 | Tremblay et al. | |
| 8,850,683 | B2 | 10/2014 | Haughey et al. | |
| 8,911,276 | B2 | 12/2014 | Kim et al. | |
| 9,022,829 | B2 | 5/2015 | Rosen et al. | |
| 9,457,288 | B2 | 10/2016 | Choi | |
| 9,782,687 | B2 | 10/2017 | Bagley et al. | |
| 9,814,998 | B2 * | 11/2017 | Wei | A63H 33/10 |
| 9,821,244 | B1 | 11/2017 | Whang | |
| 9,873,061 | B2 | 1/2018 | Cheung | |
| 9,873,062 | B2 * | 1/2018 | Purns | A63H 33/06 |
| 9,980,405 | B2 | 5/2018 | Hu et al. | |
| 10,080,977 | B2 | 9/2018 | Rosen et al. | |
| 10,328,355 | B2 | 6/2019 | Rosen et al. | |
| 10,518,190 | B2 | 12/2019 | Rosen et al. | |
| 10,722,809 | B1 * | 7/2020 | Park | A63H 33/046 |
| 2004/0043164 | A1 | 3/2004 | Vicentelli | |
| 2005/0124259 | A1 | 6/2005 | Tusacciu | |
| 2005/0159076 | A1 | 7/2005 | Kowalski et al. | |
| 2006/0014467 | A1 | 1/2006 | Tusacciu | |
| 2006/0178081 | A1 | 8/2006 | Daftari et al. | |
| 2008/0305708 | A1 | 12/2008 | Toht et al. | |
| 2009/0197500 | A1 * | 8/2009 | Song | A63H 33/046 446/92 |
| 2010/0022158 | A1 * | 1/2010 | Kim | A63H 33/046 446/92 |
| 2010/0120322 | A1 | 5/2010 | Vicentelli | |
| 2012/0270465 | A1 | 10/2012 | Park | |
| 2012/0309259 | A1 | 12/2012 | Mak | |
| 2013/0072082 | A1 * | 3/2013 | Wizenberg | A63H 33/086 446/85 |
| 2013/0111710 | A1 | 5/2013 | Hunts | |
| 2015/0065007 | A1 | 3/2015 | Klepper et al. | |
| 2015/0258461 | A1 | 9/2015 | Balanchi | |
| 2015/0325949 | A1 * | 11/2015 | Wei | H01R 13/6205 439/39 |
| 2016/0074766 | A1 | 3/2016 | Choi | |
| 2018/0126294 | A1 | 5/2018 | Rosen et al. | |
| 2018/0345156 | A1 * | 12/2018 | Bornstein | A63H 1/00 |
| 2019/0275440 | A1 * | 9/2019 | Eshet | A63H 33/046 |
| 2020/0161037 | A1 | 5/2020 | Osipov | |
| 2020/0238190 | A1 | 7/2020 | Tusacciu | |
| 2020/0346126 | A1 * | 11/2020 | Bobrikov | A63H 33/046 |

FOREIGN PATENT DOCUMENTS

| | | | |
|---|---|---|---|
| WO | 1999060583 | A1 | 11/1999 |
| WO | 2002055168 | A1 | 7/2002 |
| WO | 2005068037 | A1 | 7/2005 |
| WO | 2006044613 | A2 | 4/2006 |
| WO | 2006057471 | A1 | 6/2006 |
| WO | 2006095940 | A1 | 9/2006 |
| WO | 2006112679 | A1 | 10/2006 |
| WO | 2009007829 | A2 | 1/2009 |
| WO | 2018129380 | A1 | 7/2018 |
| WO | 2018152361 | A1 | 8/2018 |

OTHER PUBLICATIONS

U.S. Appl. No. 29/594,094, filed Feb. 15, 2017, entitled "Toy Construction Elements".

Office Action dated Jul. 2, 2018, U.S. Appl. No. 15/863,590, filed Jan. 5, 2018 (U.S. Patent Publication No. 2018/0126294).

International Search Report and Written Opinion for PCT International Patent Application No. PCT/US2018/012667, dated Jun. 20, 2018.

International Search Report and Written Opinion for PCT International Patent Application No. PCT/US2018/018418, dated May 2, 2018.

International Preliminary Report on Patentability for International Patent Application No. PCT/US2018/018418, dated Aug. 29, 2019.

U.S. Appl. No. 16/911,304, filed Jun. 24, 2020, entitled "Shell-Within-A-Shell Magnetic Toy Construction Block".

* cited by examiner

MAGNETIC TOY CONSTRUCTION BLOCK WITH RING-TYPE MAGNET

CROSS-REFERENCE TO RELATED APPLICATION(S)

This application claims priority to and the benefit of U.S. Provisional Application No. 62/867,439, filed on Jun. 27, 2019, the entire disclosure of which is incorporated herein by reference for all purposes.

FIELD

The present invention relates to magnetic modules, and more particularly, to magnetic modules that may be used with other similar or dissimilar modules in a toy construction kit for building structures.

BACKGROUND

Magnetic construction kits have become a popular category for children's toys. These kits ordinarily include construction modules having magnets embedded therein that enable the modules to be connected together via magnetism. Using these modules, children are able to assemble many imaginative two-dimensional and three-dimensional shapes and structures, thereby imparting great enjoyment and entertainment to the children using them.

SUMMARY

The present invention relates to a magnetic toy construction module (i.e., block) having a prismatic shape and a hollow interior that houses a radially magnetized ring magnet in a permanent and safe manner. A pair of pedestals extend into the interior of the module from opposite parallel end faces (i.e., caps) of the module. The pedestals cooperate to rotatably support the ring magnet in close proximity to one or more sides of the module. Because the ring magnet is rotatably supported within the interior of the module, the positions of its poles relative to the sides of the module are variable. Thus, when the module is placed adjacent another similar or dissimilar module, opposite poles of the magnets contained within the adjacent modules will automatically align to magnetically, but removably, attach the two modules together. When several modules are attached in the aforementioned manner, a user can arrange them into various different and interesting shapes and structures.

BRIEF DESCRIPTION OF THE DRAWINGS

For a more complete understanding of the present invention, reference is made to the following detailed description of various exemplary embodiments considered in conjunction with the accompanying drawings, in which.

DETAILED DESCRIPTION

Figure 1:
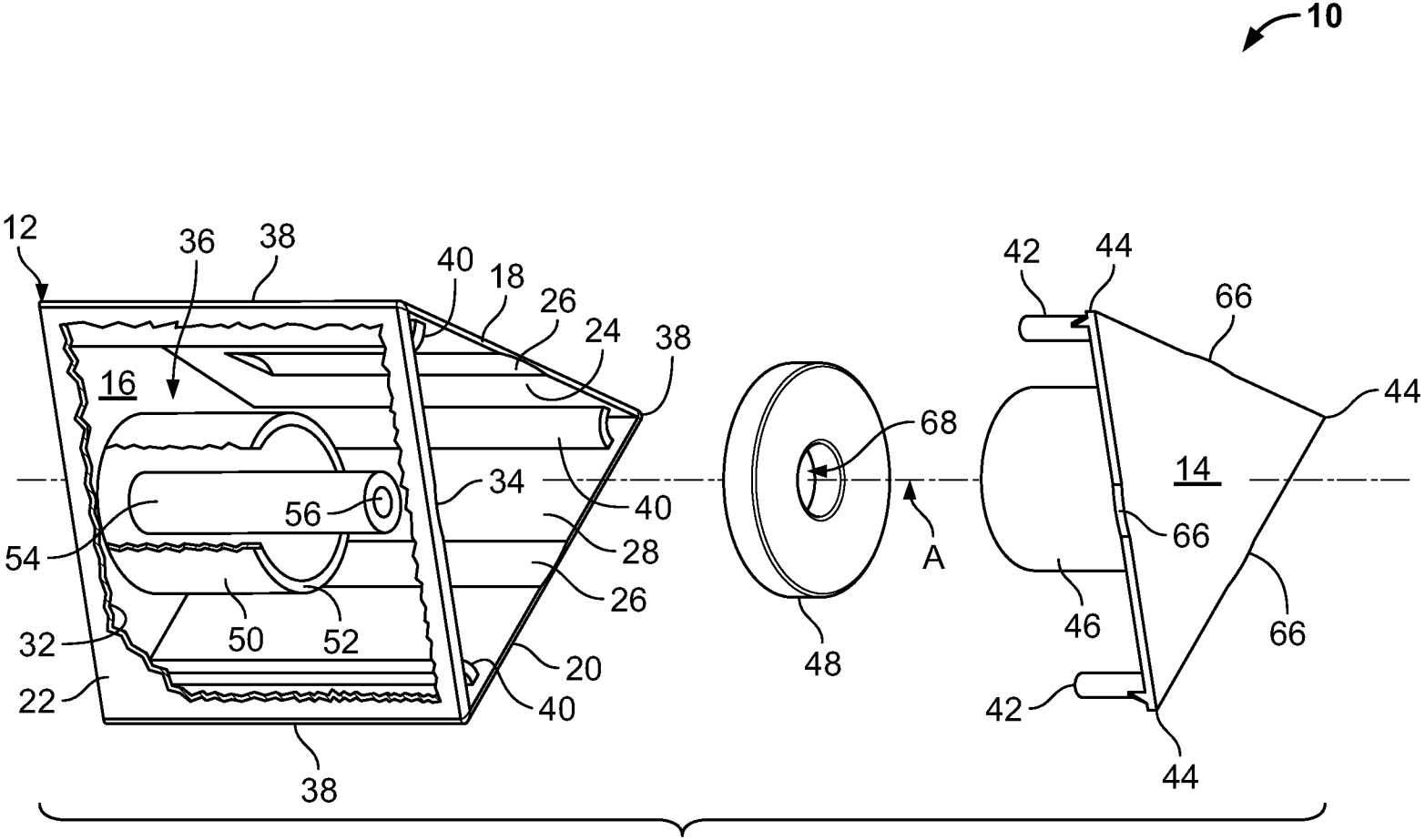
FIG. 1 is an exploded perspective view of a magnetic toy construction block representing one exemplary embodiment of the present invention, portions of certain elements of the block illustrated in FIG. 1 being broken away to facilitate consideration and discussion.
Figure 2:
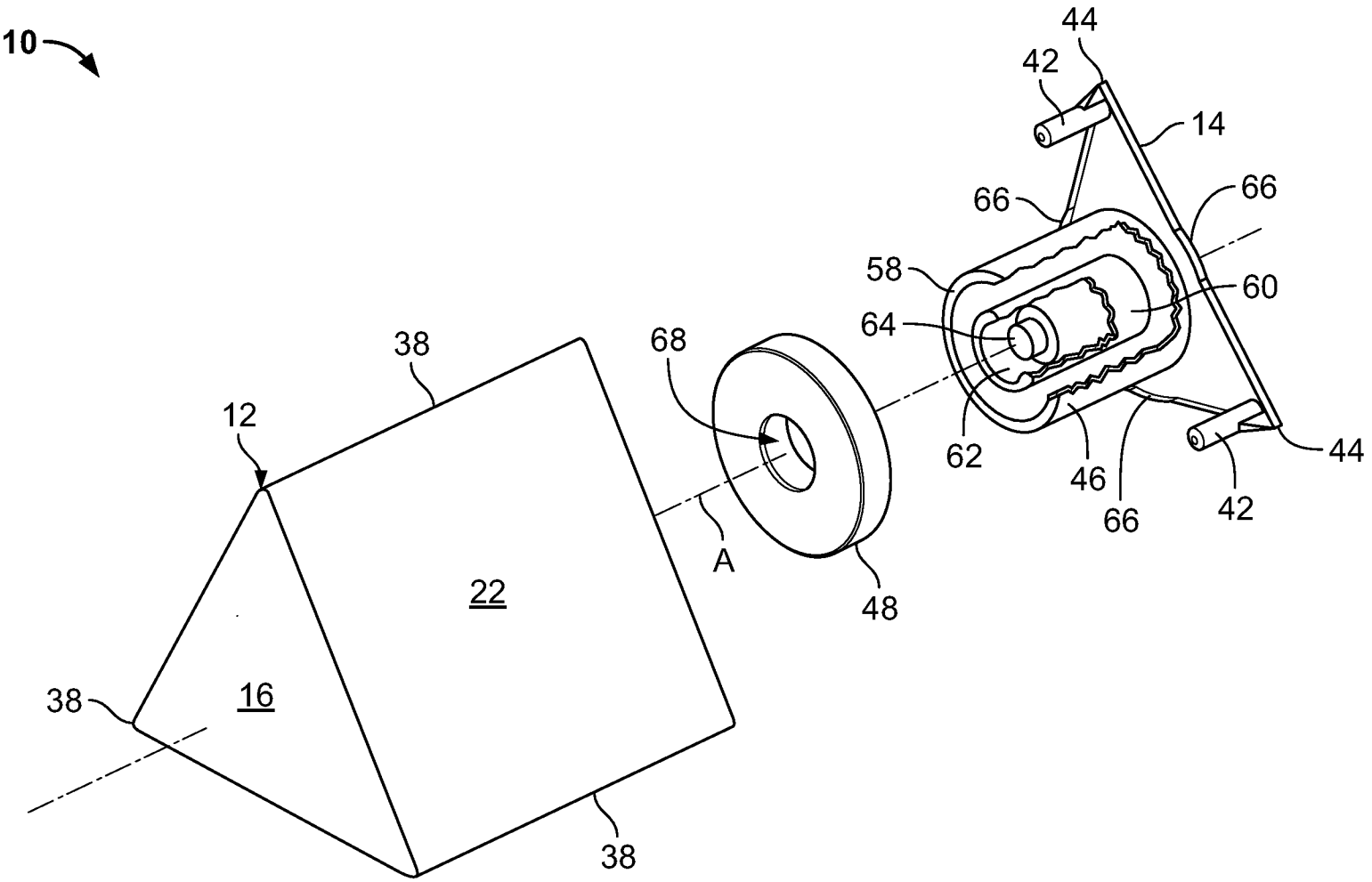
FIG. 2 is an exploded perspective view similar to FIG. 1, except that FIG. 2 is taken from a slightly different angle so that different elements of the illustrated block can be broken away to facilitate further consideration and discussion.
Figure 3:
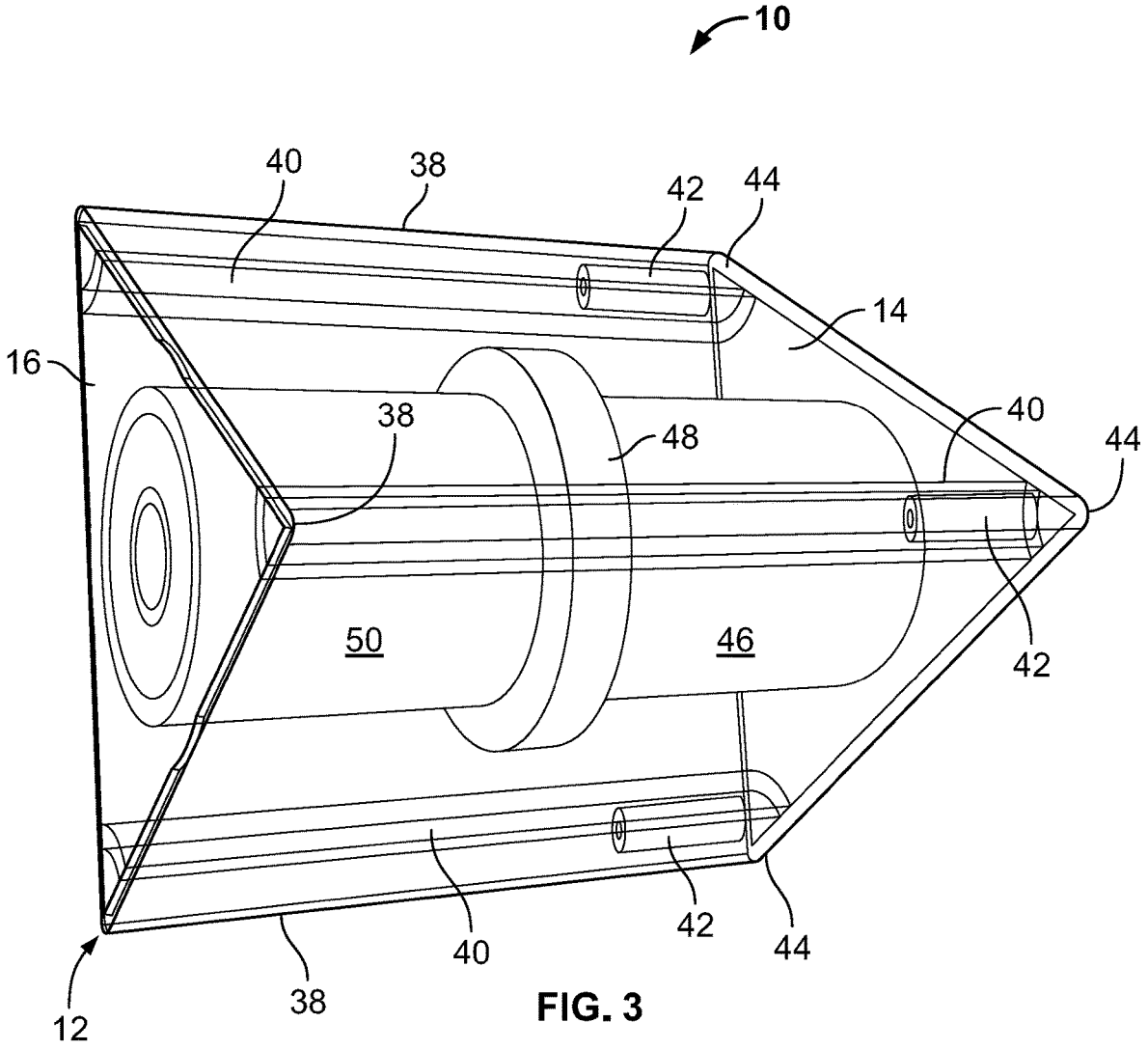
FIG. 3 is a perspective view of a magnetic toy construction block identical to the one depicted in FIGS. 1 and 2, expect that certain elements of the block illustrated in FIG. 3 are made from a transparent material and the block of FIG. 3 is depicted in an assembled state or condition.

With collective reference to FIGS. 1 and 2, a magnetic toy construction block 10 includes a housing 12 and a pair of end caps 14, 16. The housing 12 and the end caps 14, 16 are made from a non-magnetic material, such as a suitable plastic, which can be opaque, as shown, or, in the alternative, transparent (see FIGS. 3-6) or translucent.

Turning first to the housing 12, but with continued reference to FIGS. 1 and 2, the housing 12 is formed by three identical and substantially planar side panels 18, 20, 22, each of which has a rectangular shape. The side panel 18 has an interior face 24 provided with an arcuate groove or trough 26 for a purpose to be described hereinafter. Like the side panel 18, the side panel 20 has an interior face 28 provided with an arcuate groove or trough 30 for a purpose to be described hereinafter. Like the side panels 18, 20, the side panel 22 has an interior face 32 provided with an arcuate groove or trough 34 for a purpose to be described hereinafter.

Referring still to FIGS. 1 and 2, the side panels 18, 20, 22 are permanently joined together (e.g., by any suitable mechanism, such as ultrasonic welding, gluing, etc.) to form the housing 12, which is essentially an open-ended prism having a triangular cross-sectional shape. More particularly, the housing 12 has an interior 36 delimited by the side panels 18, 20, 22, one of which (i.e., the side panel 22) is broken out in FIG. 1 to facilitate consideration and discussion. The junctures of the side panels 18, 20, 22 provide the housing 12 with three longitudinal edges 38. The interior of each edge 38 includes an integrally formed, open-ended and elongated half-pipe 40 adapted to perform a socket-like function in that its open end receives a corresponding one of three mounting posts 42 (only two of which are visible in FIGS. 1 and 2, but all three being visible in FIG. 3), each of which extends inwardly (i.e., towards the end cap 16) from a respective corner 44 of the end cap 14. Before turning to a further discussion of the end caps 14, 16, it is noted that the troughs 30 and half-pipes 40 extend in a direction which is parallel to an imaginary central longitudinal axis A passing through the interior 36 of the housing 12.

Turning now to the end caps 14, 16, but with continuing reference to FIGS. 1 and 2, the end cap 14 has a tubular pedestal 46 that extends along the central longitudinal axis A and that functions as part of a support structure for a neodymium ring magnet 48. In a similar fashion, the end cap 16 has a tubular pedestal 50 that extends along the central longitudinal axis A and that cooperates with the pedestal 46 to form the support structure for the ring magnet 48, whose structure and function will be described in greater detail hereinafter.

Returning to the prior discussion of the end cap 14, each of its three mounting posts 42 is sized and shaped to be received within a corresponding one of the half-pipes 40 that extend along the longitudinal edges 38 of the housing 12. While the end cap 16 is shown as an integrated part of the housing 12, it should be understood that the end cap 16 could be formed separately from the housing 12, in which alternative form the end cap 16 could have mounting posts (not shown) similar in structure and function to the mounting posts 42 of the end cap 14.

With particular reference to FIG. 1, the tubular pedestal 50 of the end cap 16 has a circular rim 52 adapted to perform a function that will be described hereinafter. A concentric post 54 extends from the end cap 16 through the tubular pedestal 50. As can be seen in FIG. 1, the post 54 has an outer diameter that is less than the inner diameter of the pedestal 50 and a length that is greater than the length of the pedestal 50. The end of the post 54 extending beyond the rim 52 of the pedestal 50 is provided with a recess 56 for a purpose to be described hereinafter.

With particular reference now to FIG. 2, the tubular pedestal 46 of the end cap 14 has a circular rim 58 adapted to perform a function that will be described hereinafter. A concentric post 60 extends from the end cap 14 through the tubular pedestal 46. As can be seen in FIG. 2, the post 60 has an outer diameter that is less than the inner diameter of the pedestal 46 and a length that is not greater than the length of the pedestal 46. The post 60 is countersunk to form a blind bore 62, which is sized and shaped to receive the end of the post 54 containing the recess 56. The blind end of the bore 62 has a centering lug 64 adapted to be received within the recess 56 at the end of the post 54. Each edge of the end cap 14 is provided with an arcuate protuberance 66 having a shape that complements the shape of a corresponding one of the troughs 30 in the side panels 18, 20, 22 of the housing 12.

Prior to attaching the end cap 14 to the housing 12 in the manner described above, the ring magnet 48, which has a central aperture 68 extending therethrough, is slid over the post 54 until it comes into contact with the rim 52 of the pedestal 50. The end of the post 54 containing the recess 56 extends through and beyond the ring magnet 48, which is rotatably supported within the housing 12 by the pedestal 50 and the troughs 30 in the side panels 18, 20, 22.

The next step in the assembly process involves the application of the end cap 14 to the housing 12 in the manner described hereinabove (i.e., with the mounting posts 42 of the end cap 14 received in the socket-like ends of the half-pipes 40 of the housing 12). Once applied to the housing 12 in this manner, the end cap 14 would be permanently bonded to the housing 12 by any suitable mechanism, such as ultrasonic welding, gluing, etc., thereby sandwiching the ring magnet 48 between the pedestal 46 and the pedestal 50 in a longitudinally fixed but circumferentially rotatable manner. The result of such a construction is that the ring magnet 48 cannot be inadvertently or accidentally removed from the magnetic toy construction block 10 by a user or another person. In other words, the ring magnet 48 is effectively entombed within the magnetic toy construction block 10 for safety purposes and otherwise.

Figure 4:
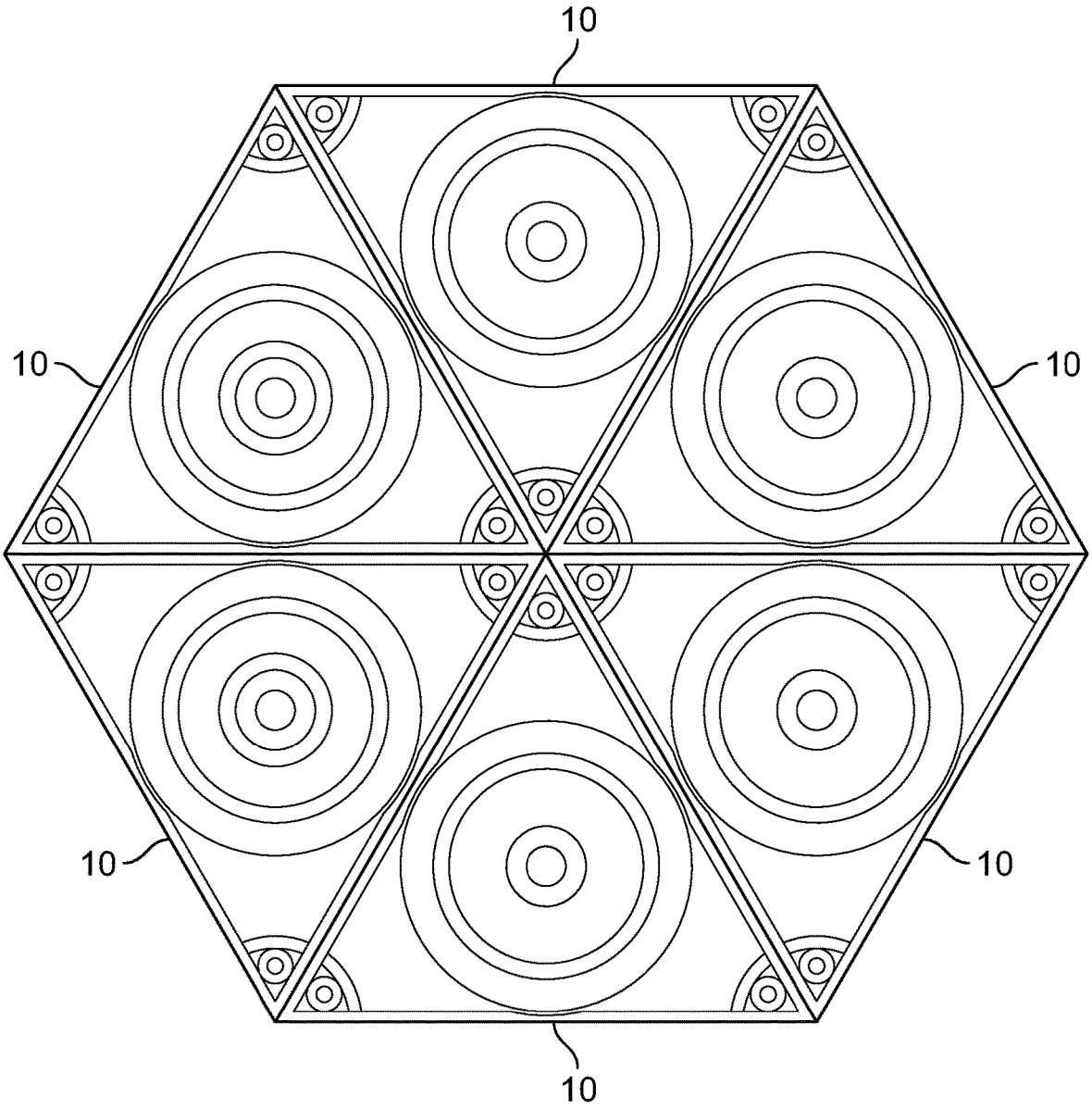
FIG. 4 is a top plan view of a plurality of magnetic toy construction blocks, each of which is identical to the block of FIG. 3, magnetically attached to together to form an assembly of magnetic toy construction blocks in accordance with one particular application of the present invention.
Figure 5:
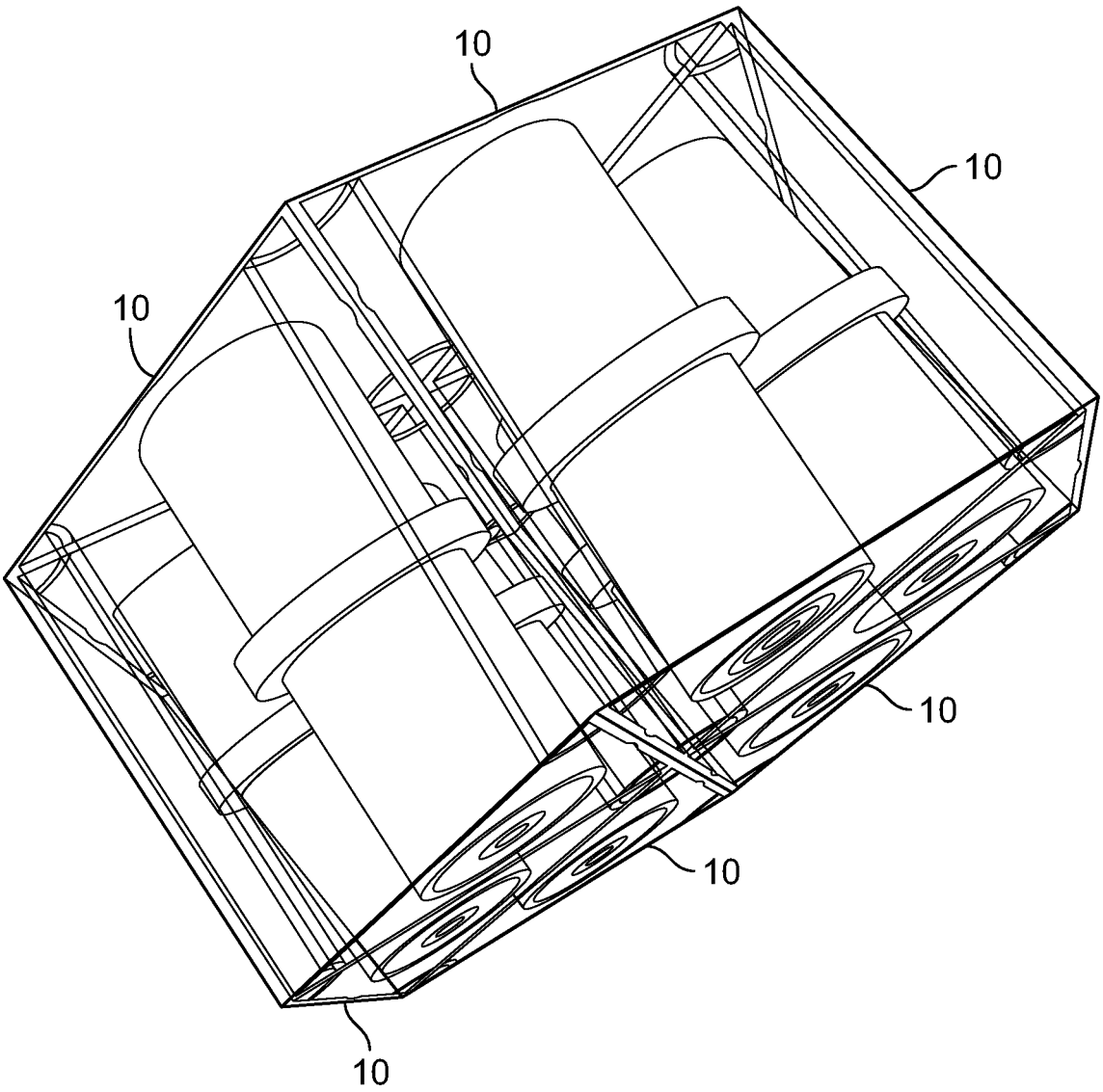
FIG. 5 is a perspective view of the assembly of magnetic toy construction blocks illustrated in FIG. 4.
Figure 6:
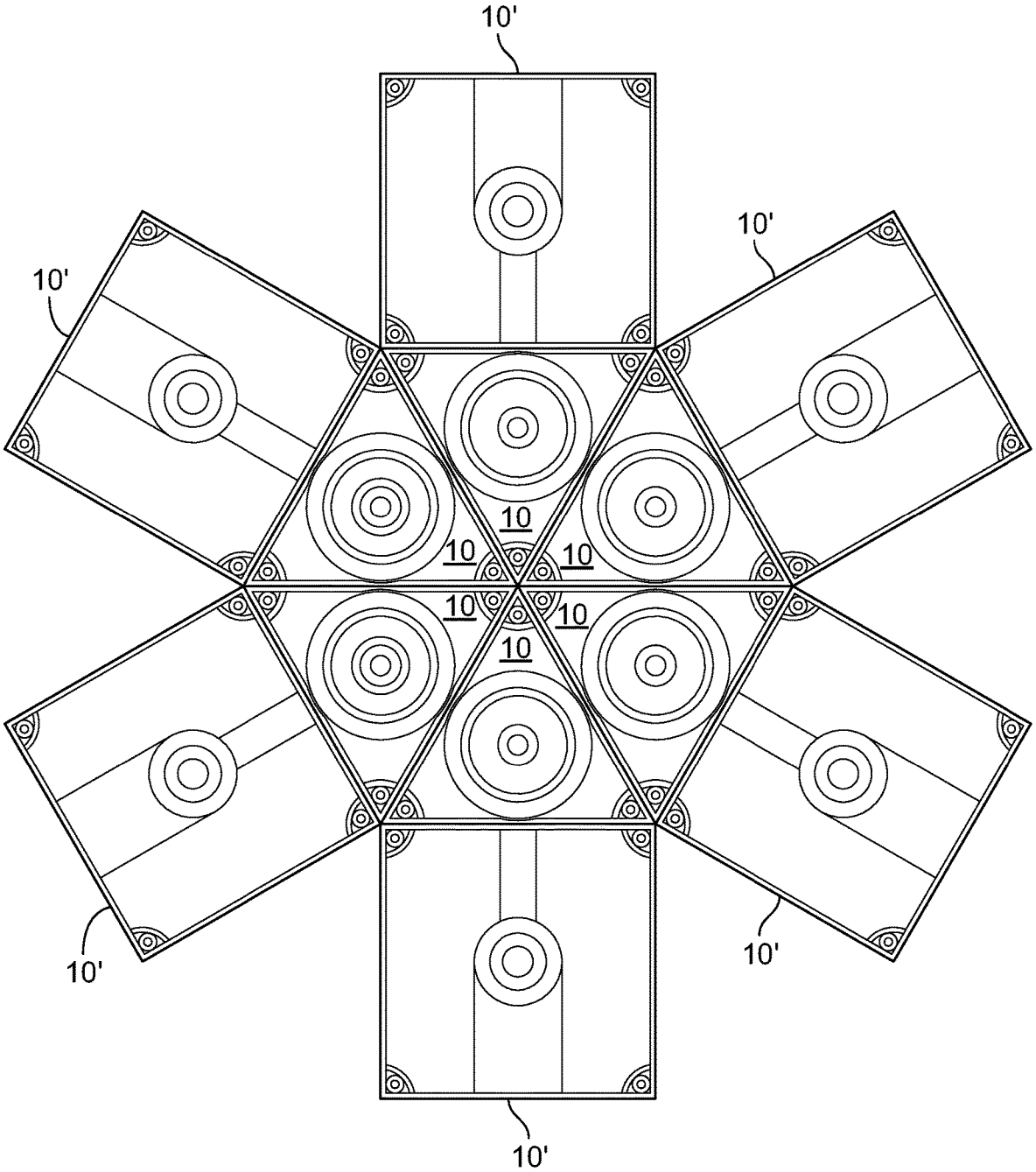
FIG. 6 is a top plan view of the assembly of magnetic toy construction blocks depicted in FIG. 4 in combination with a plurality of dissimilar magnetic toy construction blocks, thereby forming a composite assembly of magnetic toy construction blocks in accordance with another particular application of the present invention.

The ring magnet 48 is radially magnetized, whereby its poles lie in close proximity to one or more of the side panels 18, 20, 22 of the housing 12. Because the ring magnet 48 is rotatably supported within the housing 12, the positions of its poles relative to the side panels 18, 20, 22 are variable. Thus, when the magnetic toy construction block 10 is placed adjacent other similar magnetic toy construction blocks 10 (see FIGS. 4 and 5) and/or dissimilar magnetic toy construction blocks 10' (see FIG. 6), opposite poles of the magnets contained in the adjacent blocks will automatically align to magnetically attach the blocks together. When several such blocks are attached in this manner, a user can arrange the blocks into various different and interesting shapes and structures, examples of which are shown in FIGS. 4-6.

It will be understood that the embodiments described hereinabove are merely exemplary and that a person skilled in the art may make many variations and modifications without departing from the spirit and scope of the present invention. For instance, the ring-type magnet and other novel features of the above-described magnetic toy construction block 10 may lead to applications and/or uses outside the toy field.

We claim:

1. A magnetic construction block, comprising:

a housing having a plurality of sides and a pair of ends which cooperate with said plurality of sides to delimit an interior of said housing;

a ring magnet having a peripheral edge, which extends circumferentially about said ring magnet, and an aperture, which extends through said ring magnet from one face thereof to an opposite face thereof; and supporting means for rotatably supporting said ring magnet in said interior of said housing, said supporting means including a first pedestal extending from one end of said pair of ends of said housing to said one face of said ring magnet and a second pedestal extending from the other end of said pair of ends of said housing to said other face of said ring magnet, said first and second pedestals having cylindrical shapes, wherein said supporting means further includes positioning means for positioning said ring magnet such that said ring magnet is rotatable about an axis of rotation passing through said aperture of said ring magnet, said positioning means including a first post extending from said one end of said housing, through said first pedestal and said aperture of said ring magnet, and into a second post extending from said other end of said housing, the longitudinal position of said ring magnet along said axis of rotation being fixed by said first and second pedestals.

2. A magnetic construction block according to claim 1, wherein said second post extends at least partially into said second pedestal.

3. A magnetic construction block according to claim 1, wherein said supporting means further includes receiving means formed in at least one side of said plurality of sides of said housing for receiving at least a portion of said peripheral edge of said ring magnet.

4. A magnetic construction block according to claim 3, wherein said receiving means includes a plurality of grooves, each groove of said plurality of grooves being formed in a corresponding one of said plurality of sides of said housing and being sized and shaped to receive an adjacent portion of said peripheral edge of said ring magnet.

5. A magnetic construction block, comprising:

a housing having a plurality of sides and a pair of ends which cooperate with said plurality of sides to delimit an interior of said housing;

a ring magnet having a peripheral edge, which extends circumferentially about said ring magnet, and an aperture, which extends through said ring magnet from one face thereof to an opposite face thereof;

supporting means for rotatably supporting said ring magnet in said interior of said housing, said supporting means including a first pedestal extending from one end of said pair of ends of said housing to said one face of said ring magnet and a second pedestal extending from the other end of said pair of ends of said housing to said other face of said ring magnet, said first and second pedestals having cylindrical shapes;

positioning means for positioning said ring magnet such that said ring magnet is rotatable about an axis of rotation passing through said aperture of said ring magnet, wherein said positioning means includes a first post extending from said one end of said housing, through said first pedestal and said aperture of said ring magnet, and into a second post extending from said other end of said housing, the longitudinal position of said ring magnet along said axis of rotation and relative to said first post being fixed by said first and second pedestals; and receiving means formed in at least one side of said plurality of sides of said housing for receiving at least a portion of said peripheral edge of said ring magnet.

6. A magnetic construction block according to claim 5, wherein said second post extends at least partially into said second pedestal.

7. A magnetic construction block according to claim 6, wherein said receiving means includes a plurality of grooves, each groove of said plurality of grooves being formed in a corresponding one of said plurality of sides of said housing and being sized and shaped to receive an adjacent portion of said peripheral edge of said ring magnet.

8. A magnetic construction block according to claim 7, wherein said plurality of sides and said pair of ends are permanently joined together to form said housing, whereby said ring magnet is effectively entombed within said housing.

9. A magnetic construction block according to claim 8, wherein said ring magnet is a radially magnetized neodymium magnet.

10. A magnetic construction block according to claim 9, wherein said ring magnet has poles positioned in close proximity to at least one side of said plurality of sides of said housing, the positions of said poles being variable relative to said plurality of sides of said housing responsive to the rotation of said ring magnet.

11. A magnetic construction block according to claim 10, wherein said housing is made from a non-magnetic material.

12. A magnetic construction block according to claim 11, wherein said non-magnetic material is opaque.

13. A magnetic construction block according to claim 11, wherein said non-magnetic material is translucent.

14. A magnetic construction block according to claim 11, wherein said non-magnetic material is transparent.

15. A magnetic construction block according to claim 10, wherein said housing has a triangular prismatic shape, whereby said plurality of sides includes three sides.

* * * * *